US005579749A

United States Patent [19]

Wilkinson

[11] Patent Number: 5,579,749

[45] Date of Patent: Dec. 3, 1996

[54] LAUNCHER FOR TOY MISSILES

[76] Inventor: William T. Wilkinson, Sunset Dr., R.D. #1, Salem, N.J. 08079

[21] Appl. No.: 408,401

[22] Filed: Mar. 22, 1995

[51] Int. Cl.[6] ..... F41B 7/00; F41F 7/00

[52] U.S. Cl. ..... 124/17; 124/18; 124/20.1; 124/21; 124/35.1; 124/16

[58] Field of Search ..... 124/17, 18, 16, 124/1, 21, 20.1, 35.1, 41.1

[56] References Cited

U.S. PATENT DOCUMENTS

| | | | |
|---|---|---|---|
| 583,175 | 5/1897 | Harold | 124/21 |
| 707,000 | 8/1902 | Pease | 124/17 |
| 920,565 | 5/1909 | Greenwood | 124/21 |
| 1,278,514 | 9/1918 | Snyder et al. | 124/21 |
| 1,281,236 | 10/1918 | Vincent | 124/17 |
| 1,302,378 | 4/1919 | Kennedy | 124/21 |
| 1,374,242 | 4/1921 | Sekula | 124/21 X |
| 1,486,807 | 3/1924 | Skala | 124/18 X |
| 1,636,892 | 12/1926 | Tidwell | 124/18 |
| 1,827,023 | 10/1931 | Keseleff | 124/41.1 X |
| 2,092,301 | 9/1936 | Bunten | 124/21 |
| 2,287,636 | 6/1942 | Hayter | 124/21 |
| 2,334,332 | 11/1943 | Johnson | 124/17 |
| 2,708,429 | 5/1955 | Tufts | 124/18 X |
| 2,825,322 | 3/1958 | Burley, Jr. et al. | 124/35.1 X |
| 3,572,311 | 5/1971 | Baer | 124/21 |
| 3,745,986 | 7/1973 | Crowson | 124/18 X |
| 4,036,203 | 7/1977 | Chapman | 124/21 |
| 4,922,884 | 5/1990 | Ford | 124/20.1 |
| 5,267,549 | 12/1993 | Webber | 124/65 |
| 5,279,276 | 1/1994 | Nagel et al. | 124/20.1 |

*Primary Examiner*—Terry Lee Melius
*Assistant Examiner*—Thomas A. Beach
*Attorney, Agent, or Firm*—Connolly & Hutz

[57] ABSTRACT

A toy missile launching device includes a hollow barrel which simulates a bazooka. A water balloon is mounted in the barrel detachably connected to a trigger mechanism. An elastic band is secured to the water balloon and anchored to the front end of the barrel in a stretched condition when the water balloon is mounted to the trigger mechanism whereby actuation of the trigger mechanism permits detachment of the water balloon from the trigger mechanism under the contracting influence of the elastic band to launch the water balloon out of the barrel.

24 Claims, 2 Drawing Sheets

LAUNCHER FOR TOY MISSILES

BACKGROUND OF THE INVENTION

Various amusement devices exist based upon the concept of launching a missile. One particularly desirable form is to utilize water filled balloons as the missile. It would be desirable if such a device could be provided which could be conveniently-operated and manufactured at low cost while providing safety in its use so as not to injure the operator of the missile launching device.

SUMMARY OF THE INVENTION

An object of this invention is to provide such a launcher for toy missiles which meets the above needs.

A further object of this invention is to provide such a launcher which is particularly adapted for projecting water filled balloons as the missiles.

In accordance with this invention, the launcher includes a hollow barrel with a trigger mechanism extending into the barrel. An elastic projecting assembly is mounted in the barrel and attached to the trigger so that upon release of the stretched assembly from the trigger the missile is projected outwardly from the barrel when the elastic assembly contracts.

In a preferred practice of the invention the missile is a water filled balloon having a web extending outwardly from one end thereof which is detachably mounted to the pivoted trigger. The elastic projecting assembly includes at least one elastic band attached to the balloon and extending in the opposite direction where it is detachably anchored at its remote end to the downstream end of the barrel.

The invention may be practiced with variations which include a supply belt for holding a plurality of missiles in individual pockets. The barrel may be a double barrel so that two missiles or balloons could be simultaneously mounted in the device and sequentially launched.

A BRIEF DESCRIPTION OF THE DRAWINGS

DETAILED DESCRIPTION

Figures 1, 2, 3, 4, 5:
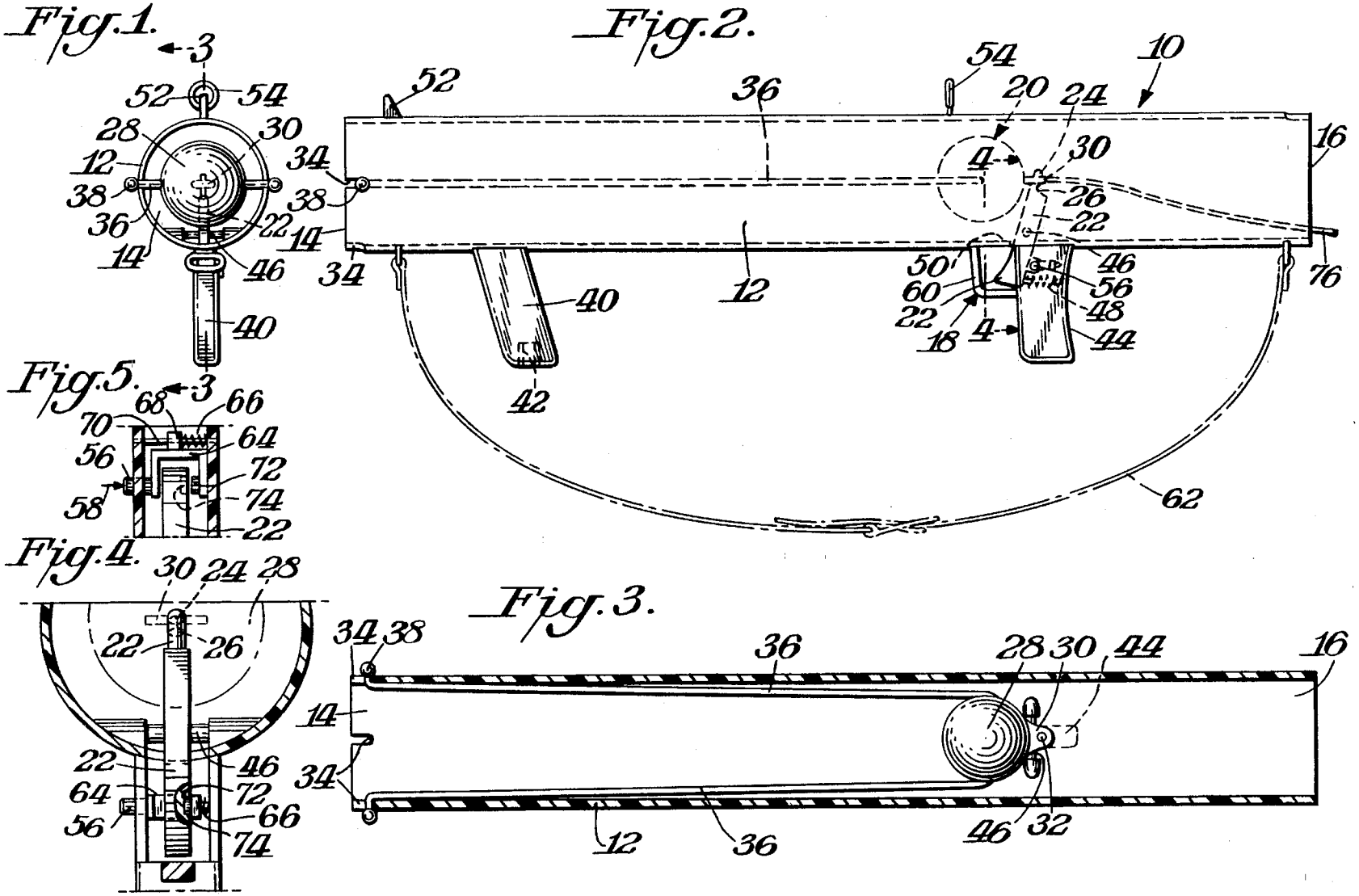
FIG. 1 is a front elevation view of a launching device for launching toy missiles in accordance with this invention.
FIG. 2 is a side elevational view of the device shown in FIG. 1.
FIG. 3 is a cross-sectional view taken through FIG. 1 along the line 3—3.
FIG. 4 is a cross-sectional end elevational view taken along the line 4—4 of FIG. 2.
FIG. 5 is a cross-sectional view of a portion of the device shown in FIGS. 1–4.

FIGS. 1–5 illustrate a launching device 10 in accordance with this invention for launching toy missiles particularly missiles in the form of water filled balloons. As shown therein, the launching device is in the form of a toy bazooka which includes an elongated barrel 12 open at both ends 14,16. A trigger mechanism 18 is mounted to barrel 12 for launching the water filled balloon 20. Trigger mechanism 18 includes a pivoted trigger arm 22 which extends into the barrel and projects out of the barrel. Arm 22 includes any suitable number, such as a pair of notches 24,26 on the portion of arm 22 mounted within barrel 12.

The missile or water filled balloon 20 includes a water filled sphere 28 having a web 30 extending from one end thereof with a hole 32 for fitting over trigger 22 and being seated in one of the notches 24,26. Front end 14 of barrel 12 includes a pair of slots 34. Elastic launching bands 36 are connected at one end to balloon 28 and are detachably anchored at their free ends 38 in slots 34.

Barrel 12 includes a hand grip 40 which may have a threaded nut 42 for threaded securement to a tripod or other stationary mounted device (not shown). The rearward end of barrel 12 includes a shoulder butt 44 which also functions as the trigger housing for trigger 22. Trigger 22 is pivotally mounted by pivot pin 46 to barrel 12. A spring 48 urges trigger 22 to rotate in a clockwise direction. The rotation, however, is limited by the edge 50 of a slot in barrel 12 through which trigger 22 extends.

Barrel 12 also includes a forward sight 52 and a rear sight 54 for properly aligning the barrel with the target.

The trigger assembly 18 includes a safety mechanism in the form of a safety pin 56, as best shown in FIG. 4 which extends transversely through trigger 22 to prevent pivoting action of trigger 22. When safety pin 56 is moved toward the right as shown by the arrow 58 in FIGS. 4 and 5 the pin is disengaged from trigger 22, thus permitting trigger 22 to be rotated by a finger squeeze action. Advantageously pin 56 could be released by pressing with the thumb immediately prior to squeezing the trigger with the finger.

As best shown in FIG. 2 a trigger guard 60 is provided to prevent accidental actuation of trigger 22. A sling or strap 62 may also be attached to barrel 12 to facilitate the carrying of device 10.

As shown in FIG. 5 a U-shaped slide member 64 is provided in shoulder butt or trigger housing 44. FIG. 5 illustrates the safety pin 58 moved to its released condition where the U-shaped slide compresses spring 66 by means of projection 68 secured to the cross-member of slide 64 being disposed on pin 70 around which spring 66 is mounted. Spring 66 generally urges the U-shaped slide to a centered position within housing 44. While in the centered position the locking portion 72 of pin 56 enters recess 74 of trigger 22 to prevent movement of trigger 22. When pin 56 is moved to the right as indicated by the arrow 58 the slide 64 is also moved to the right against the action of spring 66 to dislodge locking portion 72 from recess 74.

In operation balloon 28 would be inserted in the front end 14 of barrel 12. This could be done, for example, by holding barrel 12 vertically and permitting the water filled balloon 28 to drop downwardly. The ends 38 of launching bands 36 are mounted in slots 34. Web 30 is pulled toward the open rear end 16 of barrel 12. This may be facilitated by providing a handle 76 which could take any suitable form such as being a thread or cord of sufficient length to extend generally toward the open rear end 16. By pulling handle 76 or by inserting the fingers through the open end 16 web 30 is grasped and inserted over the desired notch 24 or notch 26. The selection of the notch controls the angle at which the balloon 28 would be projected. Arm 22 may include only one or more than two notches.

After web 30 has its hole 26 inserted over an appropriate notch, such as notch 24 of trigger 22, the device may be actuated to project the balloon 28. This is done in a sling shot fashion by releasing safety pin 56 which is squeezed toward the right as shown in FIGS. 4–5 by the thumb and then by squeezing trigger 22 against the action of spring 48 to pivot trigger 22 in a counter-clockwise direction. During this movement web 30 is detached from trigger 22 and is projected forwardly by bands 36 contracting in the manner of a sling shot and thus launched out of bazooka barrel 12 carrying with it the launching bands 36.

It is to be understood that while two launching bands 36 are illustrated, the embodiment of FIGS. 1–5 may be practiced with only a single launching band. Similarly, the handle 76 is not necessary if web 30 can be reached from the rear portion of the barrel either through the open ends 16 or by providing a slot in the barrel in the general area of trigger 22.

The invention may also be practiced where the launching band is not physically attached to the missile. For example, each end of the launching band could be mounted either permanently or detachably to the front end 14 of the barrel 12. Barrel 12 could be held upright so that the launching band drops into the barrel where the bight portion of the U-shaped band could be hooked over trigger arm 22 in the appropriate notch. The band is then in a stretched condition. The missile could then be dropped into the barrel 12 until it rests against the stretched band. Trigger 22 would then be operated in the previously described manner to release the band thereby launching the missile. Where the band is permanently secured to barrel 12 the stretched band would simply be projected from barrel 12 but would remain attached to the barrel. Where the band is detachably mounted to barrel 12 the stretched band would project from the open front end 14 and then drop to the ground so that it could be reused.

Figure 6:
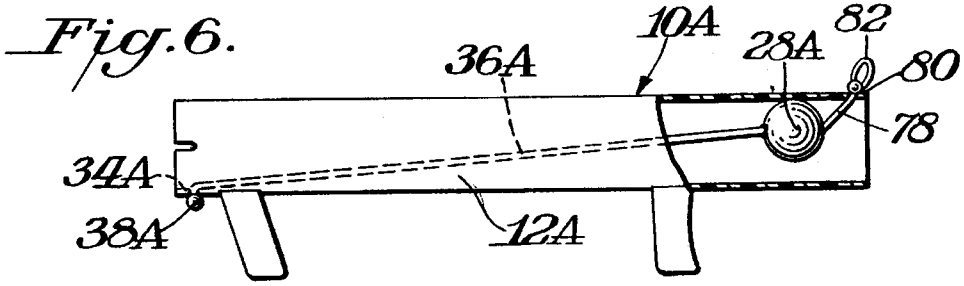
FIG. 6 is a side elevational view partly in section of another device in accordance with this invention.

FIG. 6 shows a variation of the invention wherein the device 10A is of simplified structure by omitting the trigger mechanism. Instead the balloon 28A is anchored at one end of barrel 12A by elastic band 36A having its end 38A in an appropriate slot 34A. A launching cord 78 is secured to the opposite end of barrel 28A and is mounted in slot 80 of barrel 12A. Cord 78 includes a finger loop 82 which provides easy manipulation of the cord. When in the condition shown in FIG. 6 band 36A is stretched. This in turn permits the balloon to be launched by detaching cord 78 from slot 80 whereupon the balloon is projected from the barrel 12A carrying with it launching band 36A.

Figure 7:
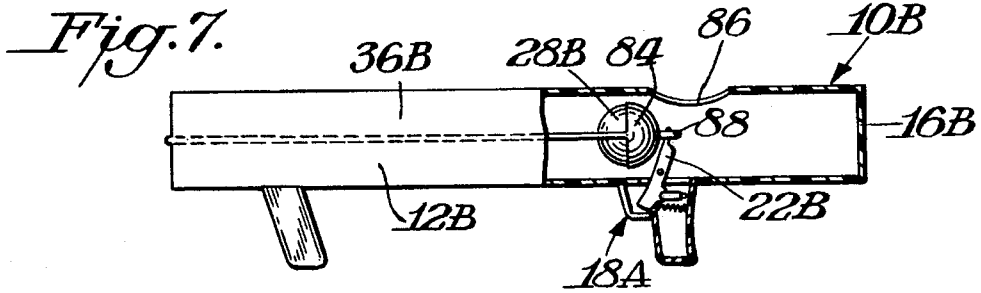
FIG. 7 is a side elevational view of still yet another embodiment of this invention.

FIG. 7 illustrates yet another variation wherein the device 10B may be used for launching a missile but wherein the missile does not include integral launching bands. In the version illustrated in FIG. 7 the rear end 16B of barrel 12B is closed. A trigger mechanism 18A is provided similar to the trigger mechanism 18 of FIGS. 1–5. With device 10B, however, a cup shaped launching pad 84 is detachably mounted to trigger 22B. The elastic bands 36B are permanently secured to barrel 12B. A missile 28B which could be a water balloon or any other type of projectile, such as a ball, is mounted in cup 84 while bands 36B are in the stretched condition. Access to the interior of barrel 12B may be had through slot or opening 86 for detachably mounting the web or extension 88 of cup pad 84 to trigger 22B. In operation when trigger 22B is squeezed, web 88 is released and cup 84 is projected forwardly carrying with it the projectile 28B. Cup 84, however, remains secured to barrel 12B after it leaves the open front end of barrel 12B, because of the permanent connection of elastic bands 36B to barrel 12B. The projectile 28B, however, continues to be projected forwardly.

Figure 8:
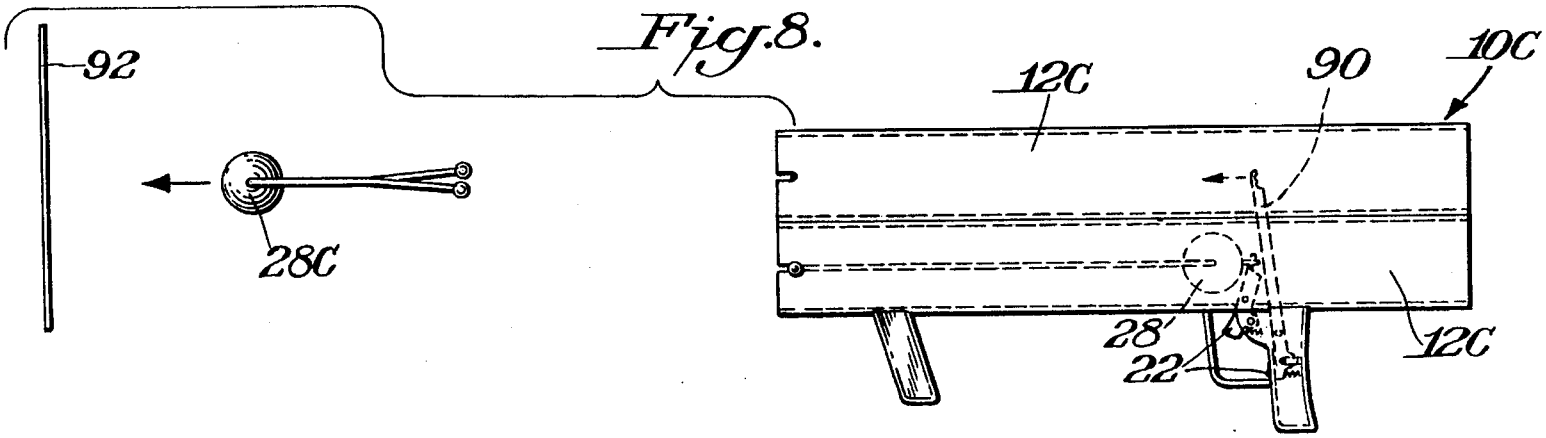
FIG. 8 is a side elevational view of still yet another embodiment in accordance with this invention.

FIG. 8 shows yet another variation wherein the device 10C is of double barrel form having a pair of barrels 12C,12C each of generally the same construction as the single barrel 12 in FIGS. 1–5. The difference in device 12C, however, is that the trigger mechanism includes a first trigger 22 secured in the lower barrel to projectile 28 in the manner described with respect to FIGS. 1–5. A second extended trigger 90 is also provided in the trigger mechanism which extends completely through the lower barrel and into the upper barrel. Elongated trigger 90 would be used for launching missile 28C from the upper barrel. In the condition shown in FIG. 8 trigger 90 has been actuated and missile 28C is being projected toward target 92. Either before or after actuating trigger 90, the lower trigger 22 may be actuated so that two missiles 28,28C can be sequentially projected with little time between the projections thereby obviating the need to completely reload after a first missile has been fired. By simultaneously actuating both triggers, both missiles can be simultaneously projected. It is within the concept of this invention to provide more than two barrels for permitting the quick projection of the appropriate number of missiles.

Figure 9:
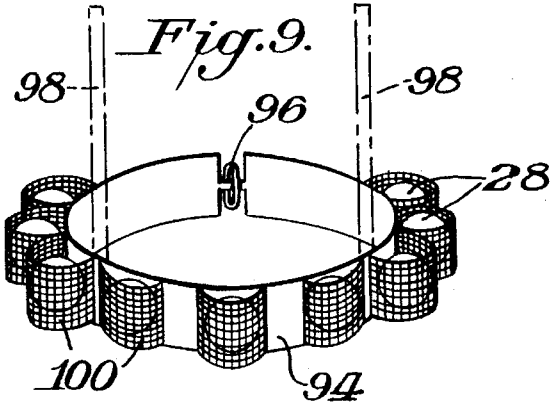
FIG. 9 is a perspective view of a missile storage belt for holding water balloon missiles usable in the devices of FIGS. 1–8.

FIG. 9 shows a useful supplement to the practice of the invention in the form of a belt 94 which would be worn on the user either in the manner of a conventional belt by attaching the free ends with clasp 96. Alternatively or in addition adjustable shoulder straps 98 may be provided to facilitate a wearing of belt 94. Belt 94 includes a plurality of pockets 100 which are preferably of open mesh form. Each pocket would contain a water balloon 28 or other projectile. It is preferred to form the pockets of open mesh form in the event there should be an accidental puncture of one of the water balloons so that the water could easily drip through the net or open mesh pockets rather than accumulating in the pockets if the pocket had been of closed form.

The belt assembly of FIG. 9 thus provides the user with a ready supply of water balloons or other missiles to enhance the enjoyment in the use of one of the projecting devices.

The invention may be practiced with other forms of missile holding devices rather than the belt 94 form illustrated in FIG. 9. Thus, for example, instead of a belt the missiles could be placed in a pouch or in a bag or sack which could be carried by the user and then placed at a convenient location so that the missiles are readily available. Alternatively, the missile holding device could be a vest or other form of garment having a plurality of individual pockets or enlarged pockets for holding multiple missiles. Where the missiles are water filled balloons it is desirable to form the pockets whether the pockets be in a belt, pouch, bag, sack or vest from a material which takes into account the possibility of a balloon breaking and the water leaking. This could be done in two opposite ways. One way would be to form the pocket material in an open mesh form as illustrated in FIG. 9 to permit the water to readily flow from and thus not be accumulated in the pockets. Alternatively, the pockets could be formed of a leak proof material so as to confine any water in the pockets and thereby avoid dripping.

It is to be understood as previously indicated that the missile need not be a water filled balloon. Instead, other forms of missiles, such as sponge balls and other known types of projectiles could be used as well as balloons filled with material other than water including color fluids which would leave a mark on the target.

A particularly advantageous feature of the invention is that the barrel 12 serves to confine the missile and various operating mechanisms, particularly the stretched band within the barrel so that these objects are self-contained and housed in a manner that would minimize the possibility of any injury to the user of the launcher.

It is to be understood that any feature described with respect to a particular embodiment may be used with other embodiments.

What is claimed is:

1. A toy missile launching device comprising a hollow barrel having an open front end, two generally diametrically opposite anchor members at said open front end, a trigger mechanism having a trigger arm with a first end extending into said barrel and a second end extending out of said barrel, at least one elastic launching band detachably mounted to said anchor members of said barrel at said front end, said launching band extending from said front end through and within said barrel and being mounted to a missile within said barrel whereby said launching band and said missile comprise a missile unit, said missile being detachably mounted to said first end of said trigger arm by a mounting member secured to said missile on a side of said missile remote from the location of attachment of said launching band to said missile, said mounting member being part of said missile unit, a handle secured to said missile on a side of said missile remote from said location of attachment of said launching band whereby a user may pull said handle in a direction away from said open front end to stretch said launching band, said handle being part of said missile unit, said launching band being in a stretched condition when said missile is mounted to said trigger arm, said trigger arm having a mounting position when said missile is mounted to said trigger arm and said launching band is in said stretched condition, said trigger arm having a release condition when said missile becomes detached from said trigger arm to permit said launching band to contract and project said missile through said barrel and out of said open front end, said second end of said trigger arm being movable by the user to selectively move said trigger arm from said mounting position to said release position, and an access opening in said barrel at a location on a side of said trigger arm remote from said location of attachment of said launching band to permit a user to grasp said handle and to stretch said launching band and to detachably secure said mounting member to said trigger arm to set said missile unit in a condition to be launched from said barrel.

2. The device of claim 1 wherein said trigger arm is pivotally mounted to said barrel.

3. The device of claim 2 wherein said mounting member comprises a web mounted to said missile, said web being separate and distinct from said handle, and said web detachably hooking onto said trigger arm.

4. The device of claim 3 wherein said anchor members comprise a pair of slots formed at said front end of said barrel, and said band being detachably secured in said slots.

5. The device of claim 4 wherein there are at least two of said elastic launching bands each of which is detachably mounted to said barrel and fixedly mounted to said missile.

6. The device of claim 3 wherein said trigger arm includes a plurality of notches, said web being selectively engageable in each of said notches for varying the angle of projection of said missile.

7. The device of claim 1 including a second barrel with a second trigger arm and a second elastic launching band and a second missile mounted in said second barrel.

8. The device of claim 1 wherein there are two of said launching bands, and said missile being a water filled balloon.

9. The device of claim 1 wherein said barrel has an open rear end to comprise said access opening.

10. The device of claim 1 including a second barrel with a second trigger arm and a second elastic launching band and a second missile mounted in said second barrel.

11. The device of claim 1 wherein said mounting member is also said handle.

12. A toy missile launching device comprising a hollow barrel having an open front end, a trigger mechanism having a trigger arm with a first end extending into said barrel add a second end extending out of said barrel, at least one elastic launching band mounted to said barrel at said front end, said launching band extending from said front end through said barrel and being mounted to a missile within said barrel, said missile being detachably mounted to said first end of said trigger arm, said launching band being in a stretched condition when said missile is mounted to said trigger arm, said trigger arm having a mounting position when said missile is mounted to said trigger arm and said launching band is in said stretched condition, said trigger arm having a release condition when said missile becomes detached from said trigger arm to permit said launching band to contract and project said missile from said barrel, said second end of said trigger arm being movable by the user to selectively move said trigger arm from said mounting position to said release position, said band being detachably mounted at one end to said barrel and being fixedly mounted at its other end to said missile, said trigger arm being pivotally mounted to said barrel, a web being mounted to said missile, said web detachably hooking onto said trigger arm, at least one slot being formed at said front end of said barrel, said band being detachably secured in said slot, there being at least two of said elastic launching bands each of which is detachably mounted to said barrel and fixedly mounted to said missile, and said trigger mechanism including a safety pin for preventing movement of said trigger arm until said safety pin is disengaged from said trigger arm.

13. The device of claim 12 wherein said trigger arm is biased to a mounting position against an edge of a slot in said barrel with said edge of said slot comprising a stop to limit the movement of said trigger arm, said safety pin being selectively mounted into and out of engagement with said trigger arm to prevent movement of said trigger arm when said safety pin is engagement with said trigger arm and said safety pin being slidably mounted to permit disengagement of said safety pin from said trigger arm to thereby release said trigger arm and permit pivotal movement of said trigger arm.

14. The device of claim 13 including a handle on said missile extending toward the rear end of said barrel for facilitating the user being able to grasp said missile for mounting said missile to said trigger arm.

15. The device of claim 14 wherein said trigger arm includes a plurality of notches, said web being selectively engageable in each of said notches for varying the angle of projection of said missile.

16. The device of claim 15 wherein said missile is a water balloon.

17. The device of claim 16 including a second barrel with a second trigger arm and a second elastic launching band and a second missile mounted in said second barrel.

18. A toy missile launching device comprising a hollow barrel having an open front end and a rear end, at least one elastic launching band mounted to said barrel at said front end, said launching band extending from said front end through said barrel and being mounted to a missile within said barrel, a launching cord mounted to said missile, said launching cord being detachably secured to the rear end of said barrel, said elastic band being in a stretched condition when said launching cord is detachably anchored to said barrel, and release of said launching cord from its anchored connection to said barrel permitting said launching band to contract and project said missile from said barrel along with said launching band and said launching cord.

19. A toy missile launching device comprising a hollow barrel having an open front end, said barrel defining a tubular passageway, a trigger mechanism having a trigger arm with a first end extending into said barrel and a second end extending out of said barrel, at least one elastic launching band mounted to said barrel at said front end, said launching band extending from said front end through said tubular passageway of said barrel and being mounted to a launching cup disposed within said barrel, said launching cup having a launching surface against which a missile may be disposed within said barrel, a mounting member secured to said launching cup and detachably mounted to said first end of said trigger arm, said launching band being in a stretched condition when said missile is mounted to said trigger arm, said trigger arm having a mounting position when said missile is mounted to said trigger arm and said launching band is in said stretched condition, said trigger arm having a release condition when said missile becomes detached from said trigger arm to permit said launching band to contract and project said missile through said tubular passageway of said barrel and out of said open front end, said second end of said trigger arm being movable by the user to selectively move said trigger arm from said mounting position to said release position, a handle secured to said launching cup to permit a user to grasp and pull said handle for stretching said launching band and for detachably mounting said mounting member to said trigger arm, an access opening in said barrel at a location on a side of said trigger arm remote from the location of attachment of said launching band to said launching cup to permit a user to grasp and pull said handle, and said launching band and said launching cup being freely movable through said tubular passageway during launching of the missile and remaining secured to said barrel after the missile is launched.

20. The device of claim 19 wherein said launching band and said launching cup have a path of motion during the launching of the missile which extends beyond said open front end of said barrel.

21. The device of claim 20 wherein said launching cup and its location of mounting to said launching band being completely disposed within said tubular passageway when said trigger arm is in said mounting position.

22. The device of claim 21 wherein said mounting member is a web.

23. The device of claim 22 wherein said trigger arm includes a plurality of notches, said web being selectively engageable in each of said notches for varying the angle of projection of said missile.

24. The device of claim 19 including a second barrel with a second trigger arm and a second elastic launching band and a second missile mounted in said second barrel.

* * * * *